United States Patent [19]

Östlund

[11] 4,423,858

[45] Jan. 3, 1984

[54] TUYERE OR NOZZLE

[75] Inventor: Artur Östlund, Linköping, Sweden

[73] Assignee: Stal-Laval Apparat AB, Sweden

[21] Appl. No.: 384,410

[22] Filed: Jun. 2, 1982

[30] Foreign Application Priority Data

Jun. 4, 1981 [SE] Sweden ..... 8103528

[51] Int. Cl.[3] ..... C21B 7/16; C21C 5/48

[52] U.S. Cl. ..... 266/270; 266/265; 266/218

[58] Field of Search ..... 266/265, 266, 218–224, 266/270; 75/130 R, 130 BB

[56] References Cited

U.S. PATENT DOCUMENTS 2,776,206 1/1957 Klingbeil ..... 75/130 R 4,298,192 11/1981 Barbakadze et al. ..... 266/218

*Primary Examiner*—L. Dewayne Rutledge

*Assistant Examiner*—Robert McDowell

*Attorney, Agent, or Firm*—Watson, Cole, Grindle & Watson

[57] ABSTRACT

A nozzle or gas tuyere for injecting gaseous and/or liquid and/or powdered material into a metallic melt, for example a steel melt. The nozzle is arranged to be mounted in an opening in a wall of a melt container, for example a ladle or furnace. The nozzle comprises a body provided with a through-going channel extending through the wall. The part of the body facing the melt is provided with a stopper which closes the channel against ingress of the melt but which is removable into the melt by the pressure of the material injected into the channel. The channel is also provided with a ball which is insertable into the channel for preventing flow of melt through the nozzle when the stopper is removed into the melt.

6 Claims, 1 Drawing Figure

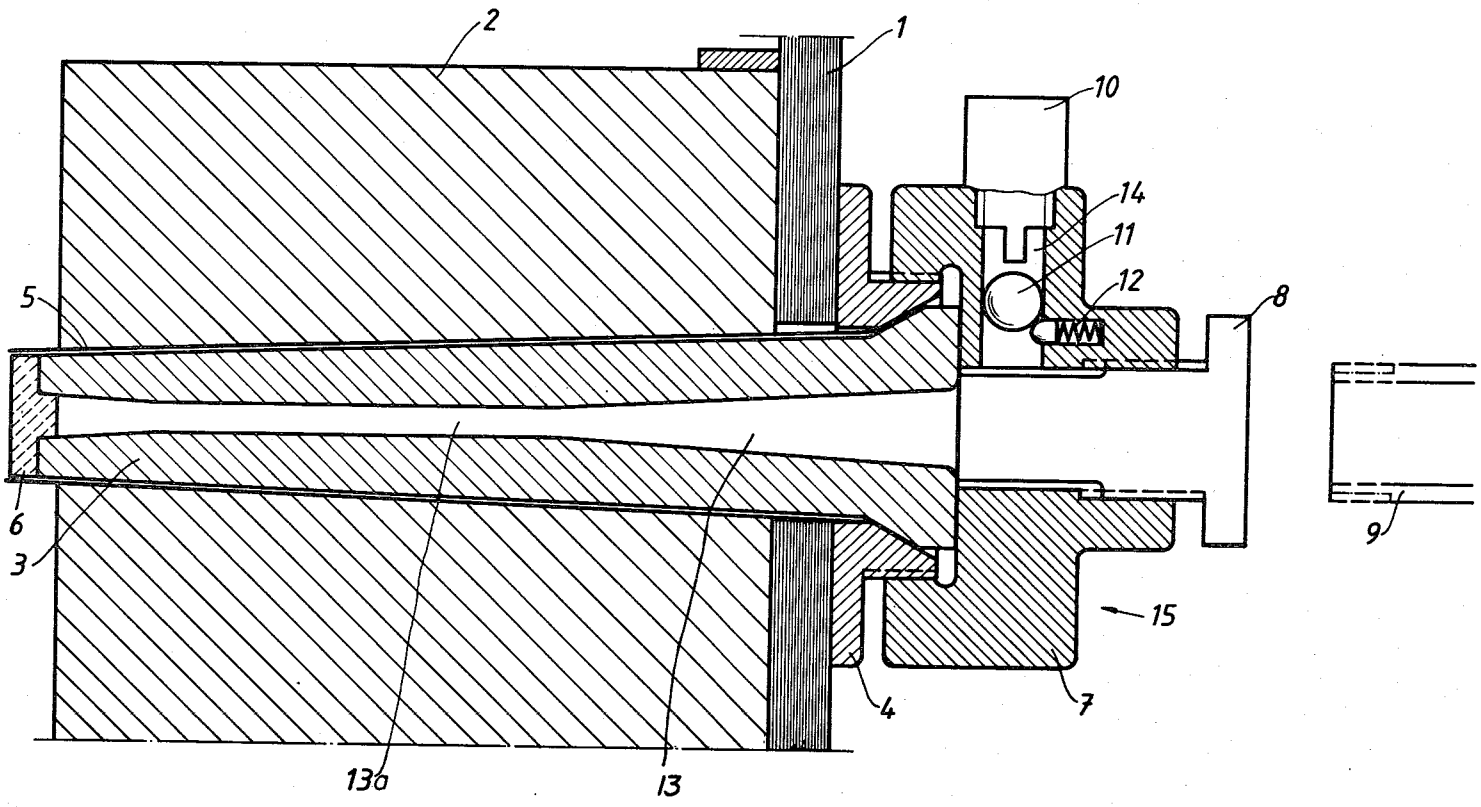
9
8
15
7
10
14
11
12
1
4
13
2
13a
5
6
3

TUYERE OR NOZZLE

TECHNICAL FIELD

This invention relates to a nozzle, tuyere or the like injection means of the kind used for injecting gaseous and/or liquid and/or powdered material into a metallic melt, for example a steel melt, and which is arranged to be mounted in an opening in a wall of a melt container, for example a ladle, furnace or converter.

In the use of melt containers, for example ladles, furnaces and converters, it is often desired to arrange the injection of gaseous and/or liquid and/or solid material into a metallic melt below the surface of the melt. The supply of such material may be for the purpose of stirring the melt and/or for introducing reaction agents or alloying additives into the melt.

BACKGROUND ART

Various nozzles of the kind referred to have been proposed for such injection purposes; see for example Folgerö et al's U.S. Pat. No. 3,971,548. Problems which arise in connection with the known nozzles are the prevention of melt being forced backwardly into the nozzle and the prevention of unintentional clogging of the nozzle.

Injection of material into melts has often been performed by means of a lance, but it is preferred to perform such injection by means of a nozzle positioned below the surface of the melt, preferably near the bottom of the melt container, so that stirring of the melt is also obtained. Furthermore, it is often desirable for the injection to be accompanied by simultaneous heating and/or vacuum treatment of the melt which is difficult to perform with lances.

The present invention aims to provide a solution to the above-mentioned problems.

DISCLOSURE OF THE INVENTION

According to the invention, a nozzle of the kind referred to, which is arranged to be mounted in an opening in a wall of a melt container, comprises a body which extends through the wall and is provided with a through-going channel, a first closure means removably mounted on the body on a part of the latter facing the melt, which closure means closes the channel against ingress of melt but is removable into the melt by the pressure of the material in the channel, and a second closure means insertable into the channel for preventing flow of melt through the nozzle when the first closure means is removed into the melt.

By means of a nozzle in accordance with the invention it is possible to blow gas into a melt, for example for stirring the melt, or to inject gaseous, liquid and/or powdered materials, for example for refining, reducing or alloying materials, into the melt. A nozzle can be arranged in which a speed of the injected material of about 80–90 m/s is obtained, and at the beginning of the injection the first closure means can be removed into the melt with a relatively moderate pressure of the material. The second closure means is intended to be inserted rapidly into the channel, for example when the injection of material into the melt has been completed or when a rapid stop is necessary.

BRIEF DESCRIPTION OF THE DRAWING

The invention will now be described, by way of example, with reference to the accompanying drawing, the single FIGURE of which is a schematic sectional view of one embodiment of a nozzle in accordance with the invention.

DESCRIPTION OF PREFERRED EMBODIMENTS

In the drawing, the numeral 1 designates the wall of a melt container, for example a ladle, converter or furnace, and the numeral 2 designates a hollow block or a piece of rammed compound with a hole for the reception of a nozzle, generally designated by the numeral 15. The nozzle 15 comprises a body 3, which is provided with a through-going channel 13 having a constriction zone 13*a* therealong. A holder 4 is attached to the outside of the melt container, for example by means of welding or screwing. To provide sealing between the hollow block 2 and the body 3, a thin, porous paper 5 of highly refractory fibre is applied around the body 3. A first closure means in the form of a lid or plug 6, made of refractory or fusion-resistant material, is applied across the open inner end of the body 3 by means of a suitable joining material. Possibly the plug 6 may also be loosely inserted into the channel 13, for example by means of a projection or the like formed on the plug. The body 3 is fixed in its position in the holder 4 by means of a cover 7 which has screwthreaded engagement with the holder 4.

In the cover 7 there is a recess 14 in the form of a channel disposed transversely with respect to the channel 13. In the recess 14 there is arranged a second closure means in the form of a ball 11, and an impulse device 10 intended to insert the ball 11 rapidly into the channel 13 for the purpose of closing the same. The numeral 12 designates a catch or locking device preventing unintentional insertion of the ball 11. A third closure means in the form of a removable stopper 8 is screwed into the cover 7.

When an injection of material (gas and/or liquid and/or powder) into the melt container is to take place, the stopper 8 is removed and a conduit means in the form of a line 9, for injection of the material is connected to the cover 7. By raising the gas pressure in the channel 13, the lid or plug 6 is blown away and injection of the material into the melt commences. When the injection is to be terminated, an impulse is given via the impulse device 10 and the ball 11 is pressed past the catch 12. The ball 11, which has a greater diameter than the narrowest section of the channel 13 in the body 3, will then stop the flow of injected material, and melt which penetrates into the channel 13 will solidify therein into a plug. The injection line 9 can then be removed and as a security measure the stopper 8 is re-inserted in the cover 7.

When the melt has been tapped or poured from the melt container, the nozzle 3 can be knocked out of the block 2 after removal of the cover 7. A fresh nozzle 3 can then be mounted in the block 2 and a new ball 11 can be placed in the recess 14.

In the embodiment shown the axis of the body 3 is disposed substantially at right angles to the wall of the melt container. However, the angle between the wall and the nozzle body can be chosen as desired, having regard to the most important function the nozzle has to fulfill, for example stirring of the melt or refining of the melt. The shape of the nozzle body may also be varied depending on its intended function.

The nozzle in accordance with the invention is particularly suitable for stirring of the melt while injecting the gaseous and/or liquid and/or powdered material, so that good stirring and a calm upper surface of melt are obtained. A calm upper surface of the melt is desirable in the case of a melt container in the form of an arc furnace, in that disturbance of the electrode adjustment is minimized.

The invention is not, of course, limited to the embodiments described above, but may be varied in many ways within the scope of the ensuing claims.

What is claimed is:

1. A device for injecting a substance into a metallic melt in a container, said device comprising an elongated body which is capable of extending through an opening in the wall of the container containing the metallic melt, said elongated body defining a substance flow channel which extends from a first end of the elongated body which is locatable externally of the container wall to a second end which can communicate with the metallic melt inside the container, a cover means which includes a flow channel extending from a first side thereof to a second side, the second side of the cover means being abuttable against the first end of said elongated body such that the flow channel in the cover means is in communication with the flow channel in the elongated body to allow a flow of substance supplied to the flow channel in the cover means from the first side thereof to flow into the flow channel in the elongated body, said cover means including an elongated recess which communicates with the flow channel therein, a first closure means removably attached to the second end of the elongated body to close off the associated mouth of the flow channel therein, a second closure means located in the recess in the cover means, the second closure means being capable of blocking off the flow channel in the cover means, an impulse means for axially moving the second closure means out of the recess and into the flow channel in the cover means, and a third closure means which is removably attached to the first side of the cover means to close off the associated mouth of the flow channel therein.

2. A device according to claim 1, wherein said second closure means comprises a ball.

3. A device according to claim 1 or 2, wherein said first closure means comprises a plate of fusion-resistant material.

4. A device according to claim 1 or 2, wherein said first closure means comprises a plate of fusion-resistant material and a projection on said plate which is mountable in the associated mouth of the flow channel in the elongated body.

5. A device according to claim 1, wherein the first side of the cover means is constructed to allow a substance supply conduit to be securely positioned in the associated mouth of the flow channel therein.

6. A device according to claim 1, wherein said elongated body is shaped such that the substance flow channel includes a constriction at a point along its length between the first and second ends of said elongated body.

* * * * *